US005441064A

United States Patent [19]

Becker et al.

[11] Patent Number: 5,441,064

[45] Date of Patent: Aug. 15, 1995

[54] COMBINATION UMBRELLA AND RAIN COVER STORAGE SYSTEM

[76] Inventors: Donald M. Becker, 3169 Summit Ave.; Russell E. Hattis, 1522 Sherwood Rd., both of Highland Park, Ill. 60035

[21] Appl. No.: 309,138

[22] Filed: Sep. 20, 1994

[51] Int. Cl.[6] ..... A45B 3/00

[52] U.S. Cl. ..... 135/16; 135/33.2; 2/22; 383/16; 383/86; 383/907; 224/915; 224/901

[58] Field of Search ..... 135/16, 33.2; 2/22, 2/242; 224/901, 311, 42.46 R, 915; 383/16, 86, 907

[56] References Cited

U.S. PATENT DOCUMENTS

| | | | |
|---|---|---|---|
| 1,204,804 | 11/1916 | McGowan | 135/33.2 |
| 1,782,504 | 11/1930 | Erhardt | 2/242 X |
| 2,681,070 | 6/1954 | D'Ippolito | 135/16 |
| 3,128,565 | 4/1964 | Graham et al. | 2/242 X |
| 3,325,084 | 6/1967 | Ansnit | 383/86 X |
| 4,154,255 | 5/1979 | Weaver | 135/16 |
| 4,674,127 | 6/1987 | Yamada et al. | 383/16 X |
| 5,040,711 | 8/1991 | Niederhauser et al. | 224/42.46 R |

FOREIGN PATENT DOCUMENTS

| | | | |
|---|---|---|---|
| 701594 | 1/1941 | Germany | 2/242 |
| 8707482 | 12/1987 | WIPO | 135/16 |

*Primary Examiner*—Lanna Mai

*Attorney, Agent, or Firm*—Wallenstein & Wagner, Ltd.

[57] ABSTRACT

An umbrella is provided a pair of legging-storage pockets on diametrically opposite sides of the center of the umbrella canopy to aid in balancing the weight of the pockets and their contents on opposite sides of the canopy center. Each of the pockets has a closeable entry opening communicating with the pocket interior and through which opening a legging body can be passed into and out of the pocket interior. A pair of folded open-ended tubular legging bodies of flexible, liquid-tight sheet material are normally stored in these pockets. Each of the tubular bodies has an open bottom with a loop-forming stirrup adapted to loop around one of the user's shoes and be pulled adjacent to the heel of the user's shoe, where it makes little or no contact with the ground to minimize wear thereof. Securing means, which are preferably a Velcro ® strip and complementary patch are provided at an outer portion of each legging-forming tubular body, to retain the outer portion of the body upon the user's leg, preferably just above the user's knee.

10 Claims, 2 Drawing Sheets

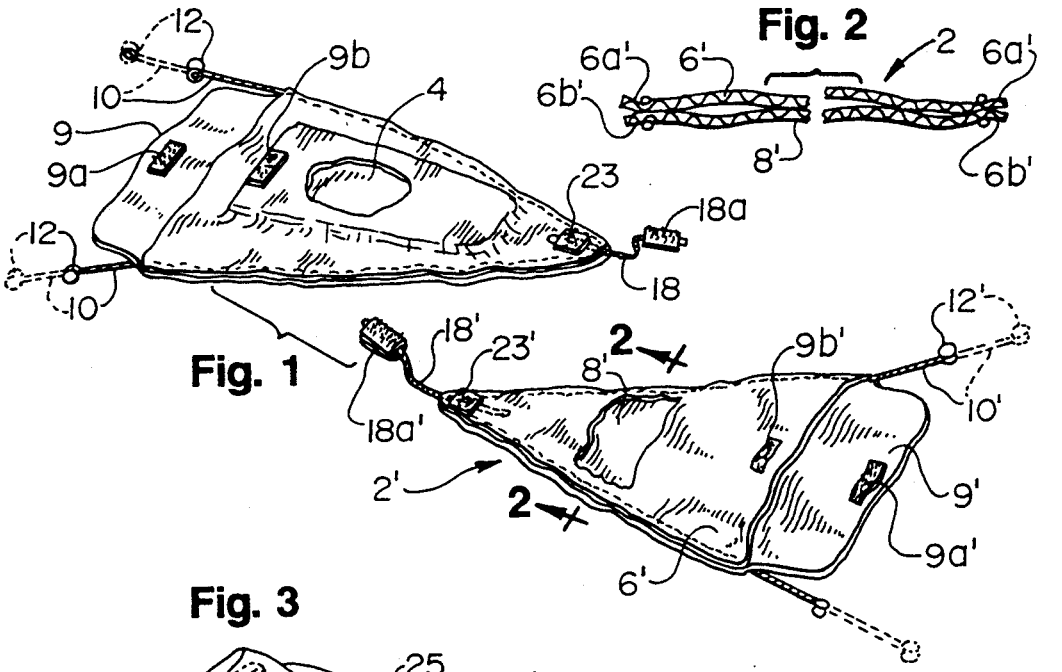
12
9b
10
4
9
9a
23
18a
12
10
18
Fig. 1
18'
23'
2
8'
9b'
12'
10'
18a'
2'
2
9'
9a'
6'
Fig. 2
6a'
6'
2
6a'
6b'
8'
6b'
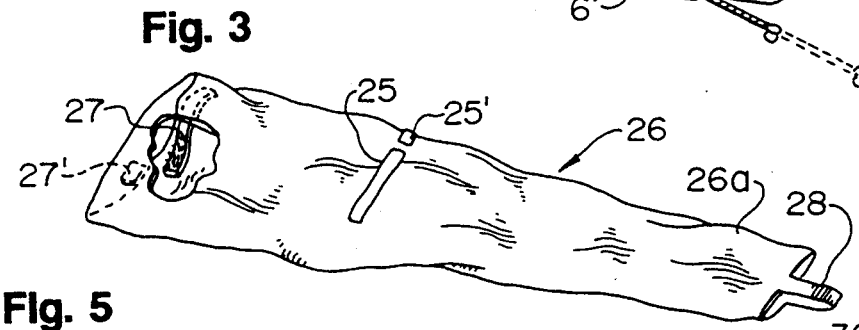
Fig. 3
27
25
25'
26
27'
26a
28
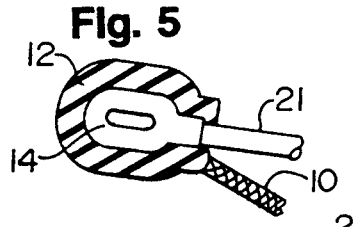
Fig. 5
12
21
14
10
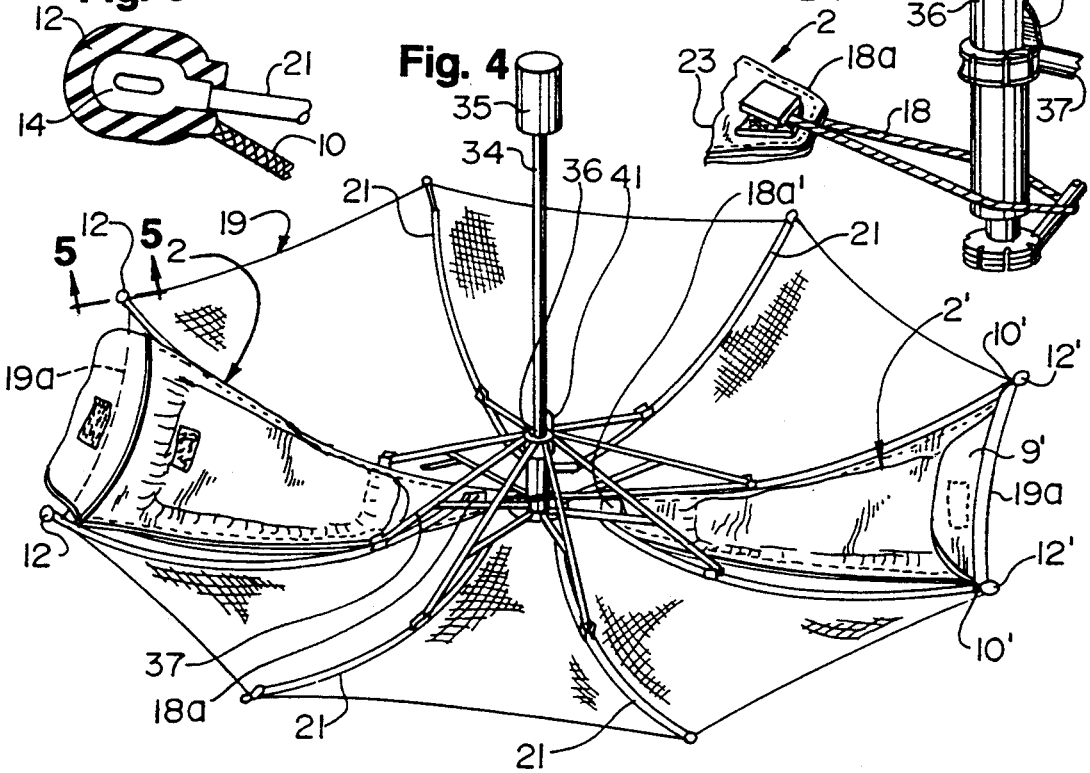
Fig. 4
35
34
36
41
21
18a'
21
12
5
5
2
19
19a
2'
10'
12'
9'
19a
12
12'
10'
37
18a
21
21
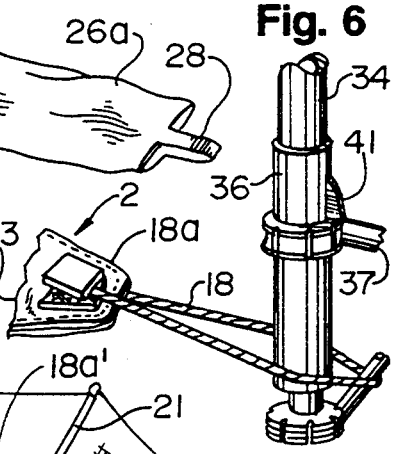
Fig. 6
34
41
36
2
23
18a
18
37

COMBINATION UMBRELLA AND RAIN COVER STORAGE SYSTEM

DESCRIPTION

TECHNICAL FIELD OF THE INVENTION

The present invention relates to umbrellas and rain cover leggings and, in the most important application of the invention, to a unique combination thereof.

BACKGROUND OF THE INVENTION

Prior to the present application, it was contemplated by some umbrella manufacturers to include in the umbrella canopy a single pocket for storing light-in-weight articles. However, the pocket was not practical for storing a raincoat, a pair of foot coverings or the like. Moreover, even if such a pocket were of adequate size to store such articles, the umbrella would have been difficult or inconvenient to hold in an elevated position over the user's head, because the umbrella would be unbalanced.

Raincoats are so bulky and heavy that it would not be practical to place a folded raincoat in an umbrella pocket. While foot coverings, like thin plastic or rubber galoshes or the like could be stored in such a pocket, it is believed that no one prior to the present invention considered designing a thin plastic tubular product which could serve as an easy-to-attach covering for a user's pants legs or exposed legs to prevent the uncomfortable and inconvenient soaking of the user's pants legs or user's legs which umbrellas cannot prevent in a heavy downpour of rain.

SUMMARY OF THE INVENTION

One embodiment of the present invention provides a unique construction of both an umbrella and a pair of tubular leggings which can be normally folded and stored in the umbrella canopy in a manner not to unbalance the umbrella, and which can be quickly and easily removed from the umbrella and secured around the user's pants legs or legs. Another aspect of the invention is the design of a pair of pockets, each of which contain one of the tubular leggings, which can be easily attached to most umbrellas in a manner which will not unbalance the umbrella. Another embodiment of the invention incorporates the pockets into the umbrella canopy during the manufacture thereof.

Accordingly, one of the features of the present invention is an umbrella provided with a pair of storage pockets on the diametrical opposite sides thereof, so that when articles like the tubular leggings described are placed in the pockets, the umbrella can remain balanced when held over the user's head. A related feature of the invention is to place in each pocket a legging which, under very heavy rain conditions, where rain is likely to splash on the user's legs or pants, can be quickly removed from the umbrella pockets and securely placed over the user's legs or pants legs. To avoid the necessity of requiring a different sized pants leg for each different leg or pants size, it is another aspect of the present invention to design the leggings so that they can be fitted over and securely attached to the legs and/or pants legs of a range of lengths and thicknesses thereof so that the invention can be conveniently marketed to encompass users of all ages and size.

While the design of the leggings to be useable with a wide variety of leg sizes has a special use with the unique umbrella of the present invention, it also has use where the leggings are carried by a user in a handbag or brief case. The manner in which the leggings are constructed to be useable with a wide variety of leg or pants leg sizes will be described in detail below.

As above indicated, the legging storage pockets can be incorporated into the umbrella when the umbrella is initially manufactured. However, as previously indicated, another feature of the invention is to manufacture the pockets separately from the umbrella, and to design them so that they can be easily attached to most existing umbrellas. The preferred manner in which this is achieved will also be described below.

Other advantages and aspects of the invention will become apparent upon making reference to the specification, claims, and drawings to follow.

BRIEF DESCRIPTION OF THE DRAWINGS

FIG. 1 is a perspective view of a pair of legging-holding pockets designed to be attached to a conventional umbrella canopy in a manner where the umbrella involved can be used in the normal manner, one of the pockets being shown as empty and the other having a folded legging therein;

FIG. 2 is a transverse sectional view through the pocket shown in FIG. 1 which has the legging removed therefrom, as taken along section line 2—2 therein;

FIG. 3 is a perspective view of one of the leggings which has been removed from one of the pockets shown in FIG. 1 and unfolded;

FIG. 4 is a perspective view showing an umbrella opened and inverted to show the pockets of FIG. 1, but both having leggings therein, and secured to the ribs of the umbrella canopy;

FIG. 5 is an enlarged fragmentary view showing the connection of one of the hollow grommets of one of the pocket-connecting cords of one of the pockets of FIG. 1 to the outer end of one of the canopy ribs of the umbrella shown in FIG. 3;

FIG. 6 is a fragmentary perspective view showing the entwining of another one of the connecting cords of one of the pockets shown in FIG. 3 with the inner end portions of a canopy rib of the umbrella shown in FIG. 3 and the connection of the end thereof to a Velcro patch on the pocket;

DETAILED DESCRIPTION OF THE INVENTION

Figure 7:
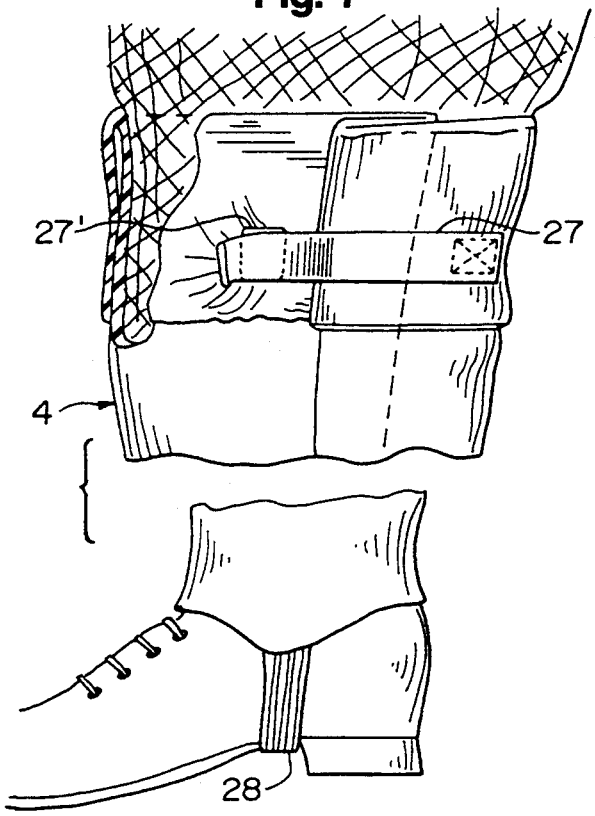
FIG. 7 is an exploded fragmentary side view which shows how the legging shown in FIG. 3 is applied around and over the upper portion of a pants leg and over the shoe of the user, so that the pants leg is protected from splashing rainwater.

While this invention is susceptible of many different forms, there is shown in the drawings and will herein be described in detail the preferred embodiments of the invention, with the understanding that the present disclosure is to be considered as an exemplification of the principles of the invention and is not intended to limit the broad aspect of the invention to the embodiments illustrated.

Refer now to FIG. 1 which shows the form of present invention which is useable with a conventional umbrella. It comprises a pair of generally triangularly shaped legging-containing pockets 2–2' which are attachable in a manner to be explained to the inside of an umbrella canopy 19 (FIG. 4) over a pair of diametrically opposite triangular panels 19*a'*—19*a'* thereof. Each pocket 2 or 2' is formed preferable by a pair of generally triangular shaped confronting panels 6,8 or 6', 8' of sheet material, which could be synthetic plastic or woven material, connected in any suitable way along a pair of opposite tapering edges like 6*a'*, 8*a'* shown in FIG. 2 from their wide end o a point or points at their narrow ends where the pockets are preferably completely closed. The confronting wide ends of the panels 6,8 or 6',8' are unconnected to leave an opening into the storage space defined between the panels 6,8 or 6',8'. Folded tubular leggings 4,4' are passable into and out of the interior of the pockets 2,2' through these openings. A flap 9 or 9' formed by an extension of the panels 8 or 8' selectively covers or uncovers these pocket openings. Each flap 9 or 9' is provided with a suitable fastener, such as a Velcro patch 9*a* or 9*a'*, which is securable to a complementary fastener, such as a Velcro patch 9*b* or 9*b'*, carried by what will be referred to as the outermost pocket panel 6 or 6' when the pocket is connected to the umbrella as shown in FIG. 3. One pocket is first secured to the umbrella structure over one of the triangular panel sections 19*a'* of the umbrella canopy 19 in a manner to be explained and the other pocket 2' is similarly secured to the umbrella frame structure over the diametrically opposite triangular panel 19*a'*, as shown in FIG. 4.

The umbrella frame structure includes a series of rib 2' extending radially outward along the inner surface of the umbrella canopy 19. A center post 34 extends from the center point of the canopy 19 and terminates at its outer end in a handle 35. A canopy expanding and contracting assembly is provided including a post-encircling member 36 slidable along the post 34 from a point adjacent the handle 35, when the canopy is in its contracted or collapsed condition, to a point adjacent the inner end of the post. In the latter position of the post-encircling member 36, the canopy 19 is in its expanded position where it acts as a rain cover. A series of links 37 are pivotally connected between the ribs 16, usually at points between the ends thereof, and the post-encircling member 36. When the post-encircling member 36 is in its position adjacent to the handle 35, the links 37 extend generally parallel to the post 34. When the post-encircling member 36 is adjacent the inner end of the post adjacent to the center of the canopy 19, the links 37 extend radially outward of the post 34, as shown in FIG. 4, to aid in holding the canopy in its expanded rain cover position. The post-encircling member 36 may be held in its position adjacent to the center of the canopy 19 where the canopy is in its expanded position by any suitable means, which may be coil spring means or a releasable spring-urged shoulder-forming member 41 as shown in FIG. 6.

In the preferred embodiment of the invention, extending from the outer face of a narrow end of the outer panel 8 or 8' of each pocket 2 or 2' is an elastic cord 18 or 18' with a Velcro patch 18*a* or 18*a'* secured to the outer end thereof. The cord 18 or 18' may be intertwined around and over the inner end of a tab or other frame element on the opposite side of the umbrella as shown in FIG. 6.

In accordance with the broadest aspect of the invention, any connecting means can be used to connect these pockets to the umbrella frame structure.

Preferably extending outward from each wide corner of the pocket 2 or 2' is an elastic cord or band 10 or 10' with a hollow plastic or metal grommet 12 or 12' at the outer end thereof, adapted to snap-fit over the hollow bead 14 commonly found at the outer end of each longitudinal margin of each triangular section 19*a'* of the umbrella canopy, as shown in FIG. 4. Each bead 14 connects the portion of the canopy involved to the end of one of the ribs 21 of the umbrella framework. The elastic cords 10 or 10' at each wide corner of the pocket 2 or 2' is then stretched substantially so each grommet 12 or 12' can reach and be connected to one of the umbrella canopy rib-connected beads 14. This stretches the other elastic cord 18 or 18' at the narrower end of the pocket involved. This stretching of the cords securely mounts the pocket involved in place on the umbrella over one of the triangular canopy sections thereof.

Figure 8:
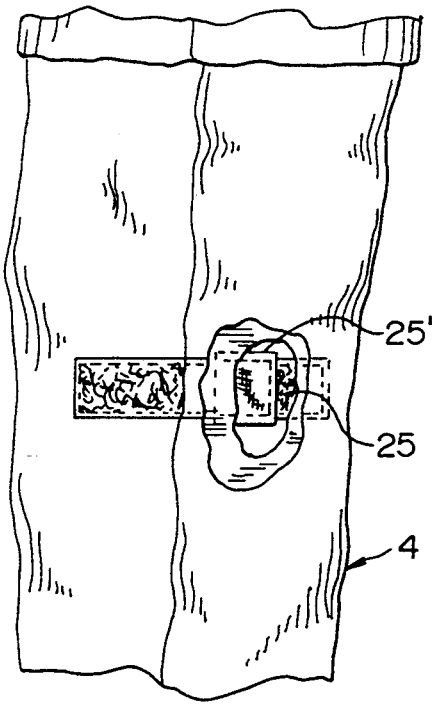
FIG. 8 is a fragmentary exploded side view showing how the legging of FIG. 7 is applied around the central portion of the pants leg, just above knee level.

FIG. 2 shows the leggings 4 or 4' when removed from the pockets 2 or 2' and unfolded. Each legging includes an open ended tubular body 26 tapered to fit a given range of leg sizes, the largest of which is determined by the fully stretched and unfolded condition of the legging body 26. Extending over the narrow open end 26*a* of the body 26 is a stirrup or strap 28 adapted to fit over the user's right or left shoe and be pulled next to the heel of the user's shoe, where it will not generally scrape along the ground as the user is walking. A long Velcro strip 25 is secured to the legging body at a point intermediate the open ends of the tubular body 26, where the body is expected to be slightly above the user's knee. The long Velcro strip 25 is shown centered and extending across the width of the legging body. A short complementary Velcro patch 25' is located at one side margin of each legging body in alignment with the associated Velcro strip 25. As shown in FIG. 8, to tightly secure the legging body over a smaller user's pants leg or leg, the side margin of the legging body 26 is grasped so that the outer margin of the body can be folded over and connected by the Velcro patch 25' to the Velcro strip 25 when the legging body tightly envelops the user's leg or pants leg. The legging body 26 will not then slip below the user's knee. If the legging body is to be made to extend over the user's thigh as shown in the drawings, a similar Velcro strip 27 and patch 27' is secured to the interior of the legging 26 along the wide open end thereof, so that the legging body 26 thereat can be folded inside out and the body gathered in and folded around the user's thigh to aid in keeping the legging on the user's leg or pants leg, as shown in FIG. 7.

Figure 9:
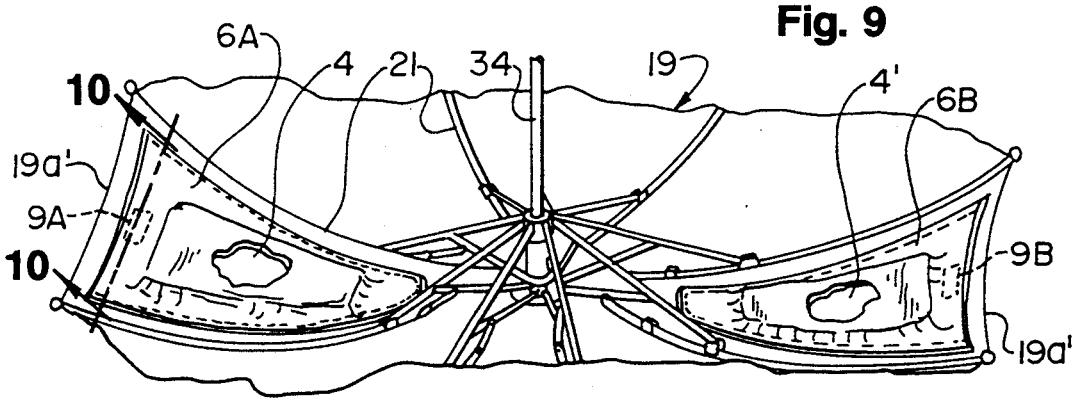
FIG. 9 is a fragmentary perspective view of an umbrella where the pockets are incorporated into the umbrella canopy when the umbrella canopy is manufactured; and, FIG. 10 is an enlarged, transverse cross-sectional view through the umbrella of FIG. 9, as seen along section line 9—9 therein.
Figure 10:
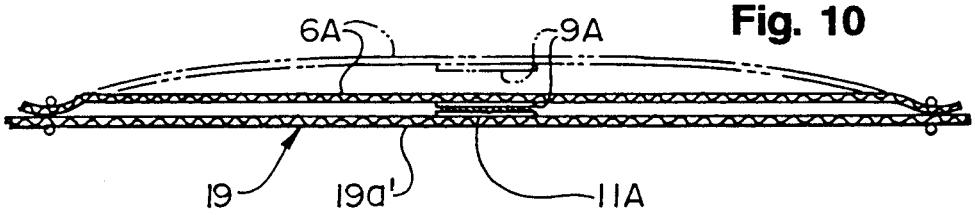

As previously indicated, the present invention is also applicable to the incorporation of legging-holding pockets into an umbrella when it is initially manufactured. This form of the invention is shown in FIGS. 8 and 9 to which reference is now made. The pockets 2A and 2B, as there shown, are formed, in part, by the triangular canopy sections 19*a'*,19*a'* on diametrically opposite sides of the umbrella canopy 19. The outermost wall of each such pocket is formed by a relatively shorter triangular panel 6A or 6B of sheet material stitched or otherwise secured along its longitudinal margins and at its narrow end to the confronting canopy panel 19*a*'. The wide end of the panel 6A or 6B is left unsecured to the canopy panel 19*a*', to leave a pass-through opening into the pocket space defined between the panels 6A or 6B and 19*a*'. The inner surface of the panel 6A or 6B at each transverse outer margin of each panel 6A or 6B is provided with a suitable fastener, like a Velcro patch 9A or 9B, so that the panel at this part can be close to the opening by being secured to a complementary fastener, like a Velcro patch 11A shown in FIG. 10, secured to the outer face of the panel 6A or 6B adjacent the pocket opening. A legging-forming body 4 or 4' is suitably folded and placed in the interior of each pocket formed between the panels 6A and 19*a*' or 6B and 19A' within the location of the Velcro patches, as shown in FIG. 9.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

We claim:

1. In combination: an umbrella comprising a canopy comprised of adjacent triangular panels of material secured together along tapering side margins;

a series of umbrella frame-forming ribs at the inner surface of said canopy adjacent to the tapering side margin of the triangular panels and extending radially outwardly from a center point of the canopy where said panels have a minimum width to the perimeter thereof, a center post connected at its inner end to the center of said canopy and having a gripping handle at the outer end thereof, and a canopy expanding and contracting assembly comprising a post-encircling member slidable along said post from a point adjacent to the outer handle-forming end thereof to a point adjacent the inner end thereof and a series of connecting links pivotally connected between said post-encircling member and said ribs;

a pair of legging-storage pockets on diametrically opposite sides of the center of said canopy to aid in balancing the weight of the pockets and their contents located on opposite sides of the canopy center thereof, each of said pockets having a closeable entry opening communicating with the pocket interior and through which opening a rain isolating legging body can be passed into and out of the pocket interior, and a pair of open-ended tubular legging bodies of flexible, liquid-tight sheet material, each insertable into one of said pockets, each of said legging-forming bodies being of a size to be positioned around one of the user's legs, each of said tubular bodies has an open bottom with a loop-forming stirrup adapted to loop around one of the user's shoes and be pulled adjacent to the heel of the user's shoe where it makes little or no contact with the ground to minimize wear thereof, and a first securing means at the outer portion of each legging-forming tubular body to retain the outer portion of the body upon the user's leg.

2. In combination: a pair of legging-storage pockets which can be secured to an umbrella frame structure at the diametrically opposite sides of the inner surface of the canopy of an umbrella, said umbrella frame structure including a series of umbrella frame-forming ribs secured to the inner surface of said canopy at the margins of triangular panels of said canopy and extending radially outwardly from the center of the canopy to the outer perimeter thereof, a center post connected at its inner end to the center point of said canopy and having at its outer end a gripping handle, and a canopy expanding and contracting assembly comprising a post-encircling member slidable along said post between a point adjacent to the handle-forming end thereof to a point adjacent the inner end thereof, and a series of connecting links pivotally connected between said post-encircling member and said ribs between the opposite ends thereof, each of said legging-storage pockets being of a tapered shape to fit between an adjacent pair of said ribs and having a relatively wide end and a relatively narrow end, each of said pockets having at the relatively wide end thereof, an entry opening to the pocket interior through which a legging body can be passed into and out of the pocket interior, and anchoring means for securing said pockets over a pair of opposite triangular panels of said umbrella canopy, and a pair of open-ended tubular legging bodies of flexible liquid-tight sheet material insertable over and around the user's legs or pants legs, each legging body being insertable after being folded into one of said pockets, each of said legging-forming bodies being of a size to be slid around one of the user's legs or pants legs and each having an open bottom with a loop-forming stirrup adapted to loop around one of the user's shoes and extend adjacent to the heel of the shoe, where it makes little or no contact with the ground to minimize wear thereof, the outer end of each legging-forming body being adapted to surround a portion of the user's leg or pants leg from shoe level to a point above the knee of the leg so that the legging body will keep rain from wetting the user's leg or pants leg bottom up to at least knee level and a first legging body securing means at the upper portion of said legging-forming body to retain the upper end portion of the legging body on the user's leg above the user's knee.

3. The combination of claim 2 wherein said anchoring means on each pocket comprises a first pocket-anchoring cord having one end secured to the narrow end of each pocket and a connector at the opposite end of said first cord for securing the cord looped on such a portion of the umbrella frame bag and the inner end of the pocket involved to the narrow ends of the pocket and a pair of pocket-anchoring cords having inner ends respectively secured to the wide ends of each pocket and outer ends with connectors for interlocking with the ends of an adjacent pair of said umbrella frame ribs.

4. The combination of claim 3 wherein each of said cords is an elastic cord of a length which requires it to be stretched to reach the portion of the umbrella with which it is to be connected so that the cords are under tension to secure the pockets to the umbrella structure.

5. The combination of claim 4 wherein there is secured to the outer ends of each of said cords extending from the wide end of each pocket a hollow grommet adapted to be telescoped over a bead secured to the end of the rib to which it is to be connected.

6. The combination of claim 1 wherein the first securing means of each of said legging-forming bodies being designed to secure the outer portion thereof to the user's leg or pants leg at a point just above the user's knee.

7. The combination of claim 1, 2 or 6 wherein said securing means includes a Velcro strip extending across the center portion of the body and a complementary Velcro patch aligned with said strip and attachable thereto so that the tubular body of the legging involved can be longitudinally folded to narrow the effective width of the body at the point involved and then secured in this folded condition so that the tubular legging body snugly surrounds the portion of the leg involved above the user's knee.

8. The combination of claims 1, 2 or 6 wherein said first securing means on each legging-forming tubular body comprises a means for securing adjustable widths of a longitudinal flap formed in said body to an adjacent portion thereof so that the legging body snugly fits legs of different thicknesses.

9. The combination of claim 1 or 2 wherein said first securing means is located adjacent to the user's knee and there is provided a second securing means at the top outer edge of each legging-forming tubular body and on the initially inner side thereof, for securing a folded over flap of a portion of the body turned inside out, to adjust the overall length of the body to accommodate different leg lengths.

10. In an umbrella comprising a canopy comprised of adjacent triangular panels of material secured together along tapering side margins;

a series of umbrella frame-forming ribs at the inner surface of said canopy adjacent to the tapering side margin of the triangular panels and extending radially outwardly from a center point of the canopy where said panels have a minimum width to the perimeter thereof, a center post connected at its inner end to the center of said canopy and having a gripping handle at the outer end thereof, and a canopy expanding and contracting assembly comprising a post-encircling member slidable along said post from a point adjacent to the outer handle-forming end thereof to a point adjacent the inner end thereof and a series of connecting links pivotally connected between said post-encircling member and said ribs, the improvement comprising a pair of storage pockets on diametrically opposite sides of the center of said canopy to aid in balancing the weight thereof on opposite sides of the canopy center, each of said pockets having a closeable entry opening communicating with the pocket interior and through which an article can be passed into and out of the pocket interior.

* * * * *